8/16/83 AO 166 EX
OR 4,399,050

United States Patent [19]
Bentham et al.

[11] 4,399,050
[45] Aug. 16, 1983

[54] BLEACH COMPOSITION

[75] Inventors: John Bentham; Jacqueline A. Coates; David L. Connell, all of Leeds, England

[73] Assignee: Sandoz Products Limited, Leeds England

[21] Appl. No.: 262,887

[22] Filed: May 13, 1981

[30] Foreign Application Priority Data

May 13, 1980 [GB] United Kingdom ..... 8015803

[51] Int. Cl.[3] ..... C11D 3/395; C11D 7/54
[52] U.S. Cl. ..... 252/95; 252/96; 252/102; 252/173; 252/174.14; 252/174.17; 252/DIG. 14
[58] Field of Search ..... 252/100, 102, 104, 95, 252/99, 174.21, 174.24, DIG. 14

[56] References Cited

U.S. PATENT DOCUMENTS

| | | | |
|---|---|---|---|
| 3,684,722 | 8/1972 | Hynam et al. | 252/98 |
| 3,758,409 | 9/1973 | Nakagawa et al. | 252/99 |
| 3,929,661 | 12/1975 | Nakagawa et al. | 252/99 |
| 4,287,079 | 9/1981 | Robinson | 252/95 |

FOREIGN PATENT DOCUMENTS

| | | | |
|---|---|---|---|
| 2160409 | 6/1972 | Fed. Rep. of Germany | 252/174.21 |
| 1346238 | 2/1974 | United Kingdom . | |
| 1466560 | 3/1977 | United Kingdom . | |
| 1466610 | 3/1977 | United Kingdom . | |
| 2003522 | 3/1979 | United Kingdom . | |
| 1548379 | 7/1979 | United Kingdom . | |
| 2015603 | 9/1979 | United Kingdom . | |

*Primary Examiner*—John E. Kittle
*Assistant Examiner*—Hoa Van Le
*Attorney, Agent, or Firm*—Gerald D. Sharkin; Richard E. Vila; Frederick H. Weinfeldt

[57] ABSTRACT

A thickened aqueous bleach composition comprising
(a) an alkali metal hypochlorite
and (b) one or more carboxylated surfactants of formula I $$RO\!\!\leftarrow CH_2CH_2O\!\!\rightarrow_n R_1\!-\!COO^{\ominus}A^{\oplus} \qquad \text{I}$$

in which
R is a straight chain $C_{6-20}$ alkyl, phenyl, a straight or branched chain $C_{7-30}$ alkaryl or a straight or branched chain $C_{7-30}$ aralkyl, unsubstituted or substituted with substituents unreactive to hypochlorite,
$R_1$ is $C_{1-4}$ alkylene,
$A^{\oplus}$ is hydrogen ion, an alkali metal cation, or an equivalently charged amount of an alkaline earth metal cation and n is 0.5 to 45. Additionally free ethoxylate can be present in the mixture together with further bleach additives including perfumes.

22 Claims, No Drawings

BLEACH COMPOSITION

This invention relates to aqueous alkali metal hypochlorite bleach compositions, and in particular to thickened bleach compositions, that is, compositions having a higher viscosity than that of a conventional aqueous hypochlorite solution.

Thickened bleach compositions possess the advantage over unthickened bleach compositions that they adhere more readily to vertical or inclined surfaces, and therefore can exert a more effective cleaning action on such surfaces, for example in lavatory pans, urinals, drains and the like.

The present invention provides a thickened aqueous bleach composition comprising (a) an alkali metal hypochlorite and (b) one or more carboxylated surfactants of formula I $$RO\text{-}(CH_2CH_2O)_n\text{-}R_1\text{-}COO^{\ominus}A^{\oplus} \qquad \text{I}$$

in which

R is a straight chain $C_{6-20}$alkyl,phenyl,a straight or branched chain $C_{7-30}$alkaryl or a straight or branched chain $C_{7-30}$aralkyl, unsubstituted or substituted with substituents unreactive to hypochlorite, $R_1$ is $C_{1-4}$alkylene, $A^{\oplus}$ is hydrogen ion, an alkali metal cation, preferably $Na^{\oplus}$, or an equivalently charged amount of an alkaline earth metal cation; and n is a number selected such that the molar percentage (E) of ethylene oxide in the group $RO\text{-}(CH_2CH_2O)_n$, or the average E in the case of mixtures of surfactants of formula I, is from 20% to 80%.

The value of n may be calculated from the formula $$n = \frac{EM}{44(100 - E)}$$

where M is the molecular weight of the group RO-.

Preferably E or the average E is 40%-70%, more preferably 50 to 65%.

Further according to the invention there is provided a thickened aqueous bleach composition comprising (a) an alkali metal hypochlorite, and (b) one or more carboxylated surfactants of formula I $$RO\text{-}(CH_2CH_2O)_n\text{-}R_1\text{-}COO^{\ominus}A^{\oplus} \qquad \text{I}$$

in which

R is a straight chain $C_{6-20}$alkyl,phenyl,a straight or branched chain $C_{7-30}$alkaryl or a straight or branched chain $C_{7-30}$aralkyl, unsubstituted or substituted with substituents unreactive to hypochlorite, $R_1$ is $C_{1-4}$alkylene, $A^{\oplus}$ is a hydrogen ion, an alkali metal cation, preferably $Na^{\oplus}$, or an equivalently charged amount of an alkaline earth metal cation, and n is selected so that the hydrophile-lipophile balance (HLB) or the molar average HLB in the case of mixture of surfactants of formula I is in the range 10 to 20.

For the carboxylated surfactants of formula I the HLB has to be determined experimentally.

HLB determination may be carried out by one or other of the methods 1 and 2 detailed below.

Method 1

Preparation of Emulsion

To 10 ml spindle oil (see Table 1 below) contained in a suitable container of approximately 100 ml capacity is added 1 ml of emulsifier, and the two components are mixed thoroughly together. 40 ml deionised water is then added to the mixture. The container is then stoppered and shaken on a mechanical shaker for 10 minutes.

Estimation of HLB

Emulsions are prepared as described above using the Atlab (a trade mark) test kit range of standard emulsifiers and any samples to be tested. All containers should be shaken simultaneously, with care being taken to ensure that the degree of agitation is the same in all cases.

The emulsions are then allowed to stand and observed at regular intervals. Each sample to be tested is ascribed the HLB value of the emulsifier from the standard range whose emulsion most closely matches it in appearance. Should the test sample appearance be intermediate between two standard emulsions, the test sample is ascribed the mean HLB of the two samples.

If test samples appear to be less well emulsified than the general trend noted with the standard range, a greater amount of test emulsifier may be employed. All emulsions must be freshly prepared, and both the relative appearance at any time, and the changes occurring with time, are noted to enable a reliable comparison to be made.

From the results of Method 1 the HLB is preferably in the range 13 to 18,more preferably 15 to 17.

The HLB value may be more precisely determined according to the "HLB requirement value" of an oil. The definition of "HLB requirement value" states that any given oil can most easily be emulsified in water using an emulsifier of a particular HLB value. This value is then referred to as an HLB requirement value. By combining various proportions of two oils with very different HLB requirement values it has been possible to produce oil mixtures with a range of HLB requirement values calculated from the HLB requirement values of component oils. Using these mixtures it is possible to define an HLB requirement value at which the surfactant being screened begins to emulsify the oil in water completely.

Method 2

Preparation of Emulsions

The following mixtures are first prepared:

| | | | | | | | |
|---|---|---|---|---|---|---|---|
| Oleic acid* | 100 | 95 | 90 | 85 | 80 | 75 | 70 |
| Heating oil* | 0 | 5 | 10 | 15 | 20 | 25 | 30 |
| (HBL requirement) | (17) | (16.65) | (16.30) | (15.95) | (15.6) | (15.25) | (14.9) |

*See Table below

To a suitable container of approximately 100 ml capacity is added 10 ml of one of the above range of oil mixtures, followed by 1 ml of the surfactant to be tested (for 100% solids or active matter, proportionately more if the surfactant is dilute). The materials are mixed thoroughly together and then 40 ml of distilled water is added.

A mixture is prepared in the above manner for each of the oil mixtures, then all containers are firmly closed and shaken for 10 minutes, ensuring uniform agitation of each sample.

Estimation of "HLB requirement Value"

The emulsions prepared as above are allowed to stand and are observed over a period of time. The samples of lower HLB requirement will begin to separate into a lower milky water layer and an upper creamy oil layer. After 4 hours the lowest HLB requirement emulsions will have a sharp boundary between upper oily and lower aqueous layers. The sample of lowest HLB requirement in which this sharp division is not observable is selected, and the surfactant is assigned this "HLB requirement value" as its HLB value.

From the results of Method 2 the HLB requirement value is preferably in the range from 15.5 to 17.0, more preferably 16.0 to 17.0, most preferably in the range 16.2 to 16.7.

TABLE 1

| | | |
|---|---|---|
| Heating Oil: | | |
| Sulphur content 0.5% wt. max. | | |
| Viscosity cST 1.5-5.5 at 40 ° C. | | |
| Cold Filter Plugging Point −9° C. max. | | |
| Water and Sediment 0.01% Vol. max. | | |
| HLB requirement 10. | | |
| Spindle Oil: | | |
| Specific gravity 0.927 | | |
| Viscosity Redwood 205 sec. at 70° F. | | |
| Pour Point −35° F. | | |
| ASTM Colour 2 | | |
| Oleic Acid (Cold Filtered): | | |
| Acid Value 198-202 | | |
| Sap. Value 198-204 | | |
| Unsaponifiables 2.5 | | |
| Composition: | Oleic acid | 73-75% |
| | linoleic/linolenic acids | 8.5-11.5% |
| | saturated acids | 12-14 |
| | HLB requirement | 17 |

In the compounds of formula I, the number n as defined either by the E calculation or by HLB determination, is within the range of 0.5-45.

Usually the compounds of formula I are present in the compositions of the invention together with the corresponding free ethoxylate of formula II $$RO\text{-}(CH_2CH_2O)_nH \qquad II$$

where R and n are defined above. Under normal circumstances it is difficult to carry out carboxyalkylation in 100% yield, and it has been found that up to about 40% of unreacted ethoxylate is usually present in carboxylated surfactants of formula I. The unreacted ethoxylates themselves have a thickening effect, but tend to be unstable in bleach, being slowly oxidized by hypochlorite to products having high HLB values. This causes the average HLB of the mixture to rise, with consequent loss of thickening of the bleach.

Nevertheless it may be desirable for a certain amount of free ethoxylate to be present, in order to obtain the desired HLB values; suitably 10-20% by weight of component (b) is present. It may even be desirable to add additional free ethoxylate to obtain reproducible HLB values, and such additional free ethoxylate may be the ethoxylate corresponding to the compound of formula I in the bleach, or an ethoxylate corresponding to another compound of formula I.

For free ethoxylates the HLB value need not be experimentally determined, but may be calculated as described in "Atlas HLB system—a time-saving guide to emulsion selection" 4th printing, Chapter 7.

Compounds of formula I are known or may be obtained conventionally from known starting materials, for example by reaction of an alcohol or phenol with ethylene oxide, followed by carboxyalkylation of the adduct so formed. Such ethylene oxide adducts will normally contain a mixture of compounds having different numbers of ethylene oxide units, so that in the corresponding compound of formula I, the number n represents an average value, which need not be integral.

In the present application, the term "mixtures of surfactants of formula I" refers to mixtures of two or more carboxylates having different average n values and/or different R groups. In such cases an E value may be calculated for each component (together with any ethoxylate present which is other than the corresponding ethoxylate), and the molar average E value calculated for the mixture.

However, the HLB value of HLB requirement value has to be experimentally determined for each carboxylated surfactant of formula I (together with any corresponding free ethoxylate present) and then the molar average HLB for a mixture of surfactants of formula I together with the HLB of any ethoxylate present which is other than the corresponding ethoxylate can be calculated. Alternatively the molar average HLB can be determined directly by experiment for the mixture of carboxylated surfactants of formula I, their corresponding ethoxylates and any other free ethoxylate present.

The thickened bleach composition may also contain as optional components one or more surface active agents selected from (c) alkali metal soaps of $C_{8-18}$ fatty acids,
(d) alkali metal sarcosinates,
(e) alkali metal taurides,
(f) amine oxides,
(g) betaines,
(h) alkanolamines,
(i) lauryl ether sulphates,
(j) sucrose surfactants comprising one or more mono- or di-esters of $C_{8-24}$ saturated or unsaturated fatty acids with sucrose, obtained by the transesterification of fatty acid esters such as triglycerides,
and (k) alkali metal alkyl sulphates.

The stability of the thickened bleach compositions may be further enhanced by the addition of an alkali metal hydroxide in quantities preferably from 0.25% to 2%, more preferably 0.25% to 1%, by weight of the composition.

The alkali metal hypochlorite component (a) above will normally be present in an amount sufficient to provide from 1 to 14%, preferably 4 to 10% by weight of available chlorine.

The carboxylated surfactant (b) is preferably of formula I in which R is a straight chain alkyl group or an alkyl-substituted phenyl group. When R is a straight chain alkyl group, it is preferably of 10 to 14 carbon atoms, bearing up to 3 substituents, preferably 0 or 1 substituent selected from halogen, aryl, alkoxy and aryloxy. More preferably, the alkyl group is unsubstituted. When R is an alkyl-substituted phenyl group, it is preferably substituted by a single $C_{4-9}$alkyl group, more preferably by a single nonyl group.

$R_1$ may be straight or branched chain $C_{1-4}$alkylene, and preferably is $C_{1-2}$alkylene, more preferably methylene.

Particularly preferred carboxylated surfactants are those of formula I'

$$R'—O\text{-}(CH_2CH_2O)_{n'}CH_2—COO^{\ominus}Na^{\oplus} \qquad I'$$

in which

R' is a mixture of predominantly straight chain $C_{12}$ and $C_{13}$alkyl groups, and n' is in the range 3–5, and those of formula I $$R''—O\text{-}(CH_2CH_2O)_{n_a}CH_2—COO^{\ominus}Na^{\oplus} \qquad I''$$

in which

R'' is a nonylphenyl group and $n_a$ is in the range 4 to 7.

Fatty acid soaps suitable for use as components (c) are of the formula $R_2$—COOM where M is an alkali metal, preferably sodium, and $R_2$ is a $C_{8-18}$ straight chain alkyl group. Examples of suitable soaps are sodium or potassium laurate.

Suitable alkali metal sarcosinates, alkali metal taurides, amine oxides, betaines and alkanolamines for use as optional components (d)–(h) are disclosed for example in British Pat. No. 1,466,560.

If one or more of the optional components (c)–(k) are present, the total amount of such components present is up to 50%, preferably up to 10%, by weight of the amount of component (b), and the total quantity of surfactant present in compositions according to the invention is preferably up to 3% by weight of the total composition, more preferably from 0.5% to 3% by weight.

The bleach compositions according to the invention may be prepared by gradual addition of the hypochlorite solution to a stirred solution of the surfactant, using conventional stirring apparatus. When sodium hydroxide is to be added this can be done before or after all the hypochlorite has been added.

Sodium chloride is a usual constituent of industrial sodium hypochlorites and is believed to contribute to the thickening effect of surfactants. Accordingly additional sodium chloride may be added to the solution.

When the total sodium chloride content is in the range 4% to 25% by weight of the total bleach composition a good stable thickening of the bleach may be reached. Below this preferred 4% figure only a partial thickening may occur which with time may thicken on storage as the hypochlorite will tend to decompose thereby producing the requisite chloride ions. In a preferred case where the bleach composition contains about 8% available chlorine a salt content in the range 7 to 12% of the total composition is advantageously used. Alternatively where the bleach composition has only about 4.8% free chlorine a salt content of about 10 to 14% by weight of the total composition would be desirably used. Once the required salt level is reached, additions of small amounts of sodium chloride will not adversely effect the viscosity of the bleach. However a large excess of added sodium chloride will tend to cause a decrease in viscosity and therefore only a partial thickening of the bleach. Thickening of the bleach can also be promoted by any bleach-stable, water-soluble electrolyte. Examples of such electrolytes are alkali metal carbonates, orthophosphates and sulphates. Preferably up to 4%, more preferably up to 3% carbonate is used and/or preferably up to 5%, more preferably up to 4% of sulphate is used.

The most preferred added electrolytes are alkali metal carbonates, particularly sodium carbonate. Mixed electrolytes can be used, particularly mixtures of sodium chloride and sodium carbonate. The amount of electrolyte used will depend on the HLB value of the surfactant system chosen.

Thickening may also be improved by the addition of a quaternary nitrogen compound (preferably a quaternary ammonium salt, examples of which are shown in British Pat. No. 1,466,560) containing at least one long chain alkyl group, either in place of or in addition to the chloride salt. Such quaternary ammonium salts may be added in quantities of up to 60% by weight of component (b) of the composition, preferably 10–40%, more preferably 15–25%. Preferred quaternary ammonium salts are $C_{14-16}$alkyl trimethyl ammonium chlorides.

Furthermore, bleach compositions according to the invention may include the incorporation of perfume and bleach-stable colourant.

A thickened bleach composition according to the invention has a viscosity of 10 centipoise or more, preferably 30–100 centipoise.

Unless indicated to the contrary in the specification all parts and percentages given are by weight. The invention will now be illustrated with reference to the accompanying Examples in which the 25% aqueous solution of the surfactant of formula I' refers to a 25% dilution of the concentrated reaction mass which contains approximately 11% salt and water.

All viscosities are measured on a Brookfield viscometer.

EXAMPLE 1

6 Parts of a 25% aqueous solution of the surfactant of formula I' above are stirred at room temperature and 92.5 parts of sodium hypochlorite solution are gradually added with stirring, the strength of the sodium hypochlorite solution being chosen such that the final composition will contain 5% available chlorine. Finally 1.5 parts of 30% sodium hydroxide solution are added with stirring.

The final composition has a viscosity of 34 cp, and is stable for several weeks at room temperature.

EXAMPLE 2

5.7 Parts of a 25% aqueous solution of the surfactant of formula I' are stirred at room temperature and 0.3 parts of a warm 25% aqueous solution of sodium laurate are added slowly with stirring, stirring being continued until the mixture is homogeneous, warming gently if necessary, 94.0 Parts of sodium hypochlorite solution (of a strength to give 5% available chlorine in the final composition) is then gradually added with stirring, ensuring that the mixture remains homogeneous throughout.

EXAMPLE 3

Example 2 is repeated, using 92.5 parts of sodium hypochlorite solution. Finally, 1.5 parts of 30% aqueous sodium hydroxide solution is added with stirring.

EXAMPLE 4

A mixture of carboxylated surfactants of general formula I' is prepared, containing 71.5% of a surfactant where n′=4.0 and 28.5% of a surfactant having n′=3.0. The mixture is made up for use as a 25% solution in water. Eight parts of this solution are then mixed with 3 parts of an aqueous 30% solution of sodium hydroxide. Quantities of water and commercial bleach solution (containing nominally 14% available chlorine) are measured out such that together they comprise 89 parts and would produce a final bleach concentration of 8% available chlorine in the mixture. The proportions required are calculated from the strength of the commercial bleach, as determined by conventional analytical methods. The water is then mixed with the alkali/surfactant component and the bleach slowly added to this mixture with stirring at room temperature. The viscosity of the mixture measured after one day is 66 cp. The sodium chloride content of the mixture, calculated from the chloride content of the commercial bleach is 9.2%.

EXAMPLE 5

Eight parts of a 25% solution in water of a surfactant of formula I′ where n′=4.0 are mixed with 3 parts of an aqueous 30% solution of sodium hydroxide. Quantities of water and commercial bleach are measured out such that together they comprise 85 parts and would produce a bleach concentration of 8% available chlorine in the final mixture. Water is then added to the surfactant/hydroxide mixture, with stirring at room temperature. Four parts of sodium chloride are then added to the mixture, and are allowed to dissolve at room temperature with stirring. The measured quantity of commercial bleach is then added slowly with stirring at room temperature. The viscosity of the thickened bleach is 76 cp after 10 days. The salt content of the mixture, calculated from analysis of the commercial bleach, plus the quantity added, is 13.2%.

EXAMPLE 6

A mixture is prepared containing 2 parts of a surfactant of formula I′, where n′=4.0, and one part sodium hydroxide. Quantities of bleach and water calculated as in Examples 4 and 5 to give a total of 95.3 parts and a final bleach strength of 4.8% are measured out. Water is added to the surfactant plus hydroxide and mixed well. The bleach is then added at room temperature with stirring to give a homogeneous mixture which has a low viscosity. Stirring is continued, and 1.79 parts of 29% aqueous solution of trimethylhexadecyl ammonium chloride is added dropwise. The mixture thickens. The viscosity measured after three weeks is 108 cp, and the sodium chloride content, calculated from measurements on the commercial bleach, is 5%. The formulation remains thick and stable over several weeks.

EXAMPLE 7

Two surfactants of general structure I″, $$R''—O—(CH_2CH_2O)_{n_a}CH_2COO^{\ominus}Na^{\oplus} \qquad I''$$

where in both cases R″ is p-nonyl phenyl and where $n_a$ is 4 and 7 respectively are mixed in the proportion 42.9:57.1 by weight. Three parts of this mixture together with one part of sodium hydroxide are dissolved in a quantity of water, calculated as in Examples 4 and 5 to give, together with the requisite quantity of bleach, a total of 96 parts and a bleach strength in the final mixture of 4.8%. The calculated quantity of bleach is then added slowly at room temperature with stirring to give a thick bleach mixture of viscosity 35 cp.

EXAMPLE 8

A blend of the carboxylates of nonylphenyl 6-ethoxylate and nonylphenyl 7-ethoxylate in the proportion 25:75% (the blend being 75% converted to the carboxylate form) is placed in a suitable vessel (as 25% solution) followed by NaOH (as 30% solution), water, salt, perfume and bleach, such that the total composition is:

| | |
|---|---|
| carboxymethylate | 2% |
| NaOH | 0.9% |
| perfume | 0.05% |
| bleach | 8% (available chlorine) |
| NaCl | 7% |
| $Na_2CO_3$ | 1.7% |

This bleach had a cloud point of 32° C. and suitable thickening.

flow cup: 57.5 secs.

viscosity: 32 cp

What is claimed is:

1. A stable thickened aqueous bleach composition comprising (a) an alkali metal hypochlorite, in an amount sufficient to provide 1 to 14% by weight of available chlorine, (b) one or more carboxylated surfactants of formula I $$RO\text{-}(CH_2CH_2O)_n R_1—COO^{\ominus}A^{\oplus} \qquad I$$

in which

R is a straight chain $C_{6-20}$alkyl, phenyl, a straight or branched chain $C_{7-30}$alkaryl or a straight or branched chain $C_{7-30}$aralkyl, unsubstituted or substituted with substituents unreactive to hypochlorite, $R_1$ is $C_{1-4}$alkylene, $A^{\oplus}$ is hydrogen ion, an alkali metal cation, or an equivalently charged amount of an alkaline earth metal cation and n is 0.5 to 45, in a total amount of 1.4 to 3.1% by weight of the composition and (c) from 4 to 25% of sodium chloride by weight of the total bleach composition, with the proviso that n is a number such that the molar percentage (E) of ethylene oxide in the group $RO\text{-}(CH_2CH_2O)_n$, or the average E in the case of a mixture of surfactants of formula I, is from 20% to 80%, and the value of n is given by the formula $$n = \frac{EM}{44\,(100 - E)},$$

where M is the molecular weight of the group RO—.

2. A bleach composition according to claim 1, in which E or the average E is 40 to 60%.

3. A bleach composition according to claim 1 in which component (b) contains 10 to 40% of its weight of an ethoxylate of the formula II $$RO\text{-}(CH_2CH_2O)_n H \qquad II$$

ps in which R and n are defined in claim 1.

4. A bleach composition according to claim 1 in which the carboxylated surfactant of formula I is of the formula I′

$$R'—O—(CH_2CH_2O)_{n'}CH_2COO^{\ominus}Na^{\oplus} \qquad I'$$

in which R′ is a mixture of predominantly straight chain $C_{12}$ and $C_{13}$ alkyl groups and n′ is in the range 3 to 5.

5. A bleach composition according to claim 1 in which the carboxylated surfactant of formula I is of formula I″

$$R''—O—(CH_2CH_2O)_{n_a}CH_2COO^{\ominus}Na^{\oplus} \qquad I''$$

where R″ is p-nonyl phenyl and $n_a$ is in the range 4 to 7.

6. A bleach composition according to claim 1 including up to 10% added, water soluble, alkali-stable electrolyte.

7. A composition according to claim 1 which contains 7 to 25% sodium chloride.

8. A composition according to claim 1 wherein, in formula I, R is either a straight chain alkyl group of 10 to 14 carbon atoms containing 0 to 3 substituents selected from halogen, aryl, alkoxy and aryloxy, or a phenyl group monosubstituted by a $C_{4-9}$alkyl group.

9. A composition of claim 2 having a viscosity of at least 10 centipoise.

10. A composition of claim 3 in which from 10 to 20% by weight of ethoxylate of formula II is present, based on the weight of component (b) present.

11. A composition according to claim 7 having a viscosity of 30 to 100 centipoise.

12. A composition according to claim 11 wherein, in formula I, R is either a straight chain alkyl group of 10 to 14 carbon atoms containing 0 to 3 substituents selected from halogen, aryl, alkoxy and aryloxy, or a phenyl group monosubstituted by a $C_{4-9}$alkyl group.

13. A composition of claim 9 having a viscosity of 30 to 100 centipoise.

14. A stable thickened aqueous bleach composition comprising (a) an alkali metal hypochlorite, in an amount sufficient to provide 1 to 14% by weight of available chlorine (b) one or more carboxylated surfactants of formula I $$RO\text{+}CH_2CH_2O\text{+}_nR_1—COO^{\ominus}A^{\oplus} \qquad I$$

in which

R is a straight chain $C_{6-20}$alkyl, phenyl, a straight or branched chain $C_{7-30}$alkaryl or a straight or branched chain $C_{7-30}$aralkyl, unsubstituted or substituted with substituents unreactive to hypochlorite, $R_1$ is $C_{1-4}$alkylene, $A^+$ is hydrogen ion, an alkali metal cation, or an equivalently charged amount of an alkaline earth metal cation and n is 0.5 to 45, in a total amount of 1.4 to 3.1% by weight of the composition, and (c) from 4 to 25% of sodium chloride by weight of the total bleach composition, with the proviso that n is a number such that the hydrophile-lipophile balance (HLB) is herein defined or the molar average HLB in the case of a mixture of surfactants of formula I is in the range of 10 to 20.

15. A bleach composition according to claim 14 in which the HLB or average HLB is in the range 13 to 18.

16. A composition of claim 14 having a viscosity of 30 to 100 centipoise.

17. A composition according to claim 14 which contains 7 to 25% sodium chloride.

18. A composition according to claim 14 wherein, in formula I, R is either a straight chain alkyl group of 10 to 14 carbon atoms containing 0 to 3 substituents selected from halogen, aryl, alkoxy and aryloxy, or a phenyl group monosubstituted by a $C_{4-9}$alkyl group.

19. A composition according to claim 17 having a viscosity of 30 to 100 centipoise.

20. A composition according to claim 19 wherein, in formula I, R is either a straight chain alkyl group of 10 to 14 carbon atoms containing 0 to 3 substituents selected from halogen, aryl, alkoxy and aryloxy, or a phenyl group monosubstituted by a $C_{4-9}$alkyl group.

21. A stable thickened aqueous bleach composition comprising (a) an alkali metal hypochlorite, in an amount sufficient to provide 1 to 14% by weight of available chlorine.

(b) one or more carboxylated surfactants of formula I $$RO\text{+}CH_2CH_2O\text{+}_nR_1—COO^{\ominus}A^{\oplus} \qquad I$$

in which

R is a straight chain $C_{6-20}$alkyl, phenyl, a straight or branched chain $C_{7-30}$alkaryl or a straight or branched chain $C_{7-30}$aralkyl, unsubstituted or substituted with substituents unreactive to hypochlorite, $R_1$ is $C_{1-4}$alkylene, $A^{\oplus}$ is hydrogen ion, an alkali metal cation, or an equivalently charged amount of an alkaline earth metal cation and n is 0.5 to 45, and (c) from 7 to 25% of sodium chloride by weight of the total bleach composition, with the proviso that n is a number such that the molar percentage (E) of ethylene oxide in the group $RO\text{+}CH_2CH_2O\text{+}_n$, or the average E in the case of a mixture of surfactants of formula I, is from 20% to 80%, and the value of n is given by the formula $$n = \frac{EM}{44\,(100 - E)},$$

where M is the molecular weight of the group RO—.

22. A stable thickened aqueous bleach composition comprising (a) an alkali metal hypochlorite, in an amount sufficient to provide 1 to 14% by weight of available chlorine, (b) one or more carboxylated surfactants of formula I $$RO\text{+}CH_2CH_2O\text{+}_nR_1—COO^{\ominus}A^{\oplus} \qquad I$$

in which

R is a straight chain $C_{6-20}$alkyl, phenyl, a straight or branched chain $C_{7-30}$alkaryl or a straight or branched chain $C_{7-30}$aralkyl, unsubstituted or substituted with substituents unreactive to hypochlorite, $R_1$ is $C_{1-4}$alkylene, $A^+$ is hydrogen ion, an alkali metal cation, or an equivalently charged amount of an alkaline earth metal cation and n is 0.5 to 45, and (c) from 7 to 25% of sodium chloride by weight of the total bleach composition, with the proviso that n is a number such that the hydrophile-lipophile balance (HLB) as herein defined or the molar average HLB in the case of a mixture of surfactants of formula I is in the range of 10 to 20.

* * * * *